US005279170A

United States Patent [19]

Chen

[11] Patent Number: 5,279,170

[45] Date of Patent: Jan. 18, 1994

[54] JUMPING MECHANISM

[76] Inventor: Hwa-Lo Chen, 5F, No. 56, Chin-Chiang St., Taipei City, Taiwan

[21] Appl. No.: 987,618

[22] Filed: Dec. 9, 1992

[51] Int. Cl.[5] ..... F16H 27/04; A63H 13/02

[52] U.S. Cl. ..... 74/84 R; 446/312

[58] Field of Search ..... 74/84 R, 845, 52; 446/309, 311, 446/312

[56] References Cited

U.S. PATENT DOCUMENTS

| | | | |
|---|---|---|---|
| 2,253,183 | 8/1941 | Le Count | 74/84 R X |
| 3,452,613 | 7/1969 | Steinke | 74/84 R X |
| 4,308,686 | 1/1982 | Ikeda | 446/312 |

FOREIGN PATENT DOCUMENTS

| | | | |
|---|---|---|---|
| 585648 | 9/1933 | Fed. Rep. of Germany | 446/312 |
| 1154484 | 4/1958 | France | 446/309 |
| 452894 | 7/1951 | Italy | 446/312 |

*Primary Examiner*—Rodney H. Bonck
*Assistant Examiner*—David W. Laub

[57] ABSTRACT

A jumping mechanism includes a support frame and a swing arm pivoted to the support frame. A U-shaped leg has a pair of vertically extending parts which are mounted pivotally to the swing arm. The support frame is movable relative to the vertically extending parts in a vertical direction. A jumping control unit has a rotary cam plate which is mounted on the support frame and which rotates in a predetermined direction. The cam plate is disposed below and has a periphery which abuts with an outward projection of the swing arm. One end of a tension spring is hooked to an upper rear end of the swing arm, while the other end thereof is hooked to an upper front end of the support frame. Rotation of the cam plate initially causes the cam plate to urge the outward projection upward so as to cause the swing arm to pivot upwardly from a first position relative to the support frame. Pivoting movement of the swing arm causes the tension spring to stretch and further causes the support frame to move vertically downward relative to the U-shaped leg. Further rotation of the cam plate eventually causes the cam plate to cease upward urging of the outward projection, thereby causing the tension spring to contract instantaneously. The swing arm pivots instantaneously back to the first position and lifts the U-shaped leg so as to enable the jumping mechanism to execute a jumping movement.

5 Claims, 7 Drawing Sheets

JUMPING MECHANISM

BACKGROUND OF THE INVENTION

The invention relates to a movement generating mechanism, more particularly to a jumping mechanism which can generate a forward jumping action and which has provisions for controlling the direction of forward movement.

The objective of the present invention is to provide a jumping mechanism which includes a jumping control unit for causing forward jumping movement of the jumping mechanism and a direction control unit for controlling the direction of forward movement by the jumping mechanism.

SUMMARY OF THE INVENTION

Accordingly, the preferred embodiment of a jumping mechanism of the present invention comprises:

a support frame having a spaced pair of first side walls and a rod which extends between the first side walls adjacent to a front end of the support frame;

a swing arm having a spaced pair of second side walls pivoted to the first side walls of the support frame adjacent to a rear upper end of the support frame, one of the second side walls being provided with an outward projection;

a base;

a U-shaped leg having a pair of vertically extending parts and a bottom part which interconnects lower ends of the vertically extending parts, each of the vertically extending parts having an upper end that is mounted pivotally on a corresponding one of the second side walls, each of the vertically extending parts further having a vertically extending slot, said rod extending through the vertically extending parts via the slots, said bottom part being mounted rotatably on the base;

one of the base and the bottom part of the U-shaped leg being formed with a peripheral notch, the other one of the base and the bottom part of the U-shaped leg being formed with a protrusion which is received in the notch when the U-shaped leg is at a normal position relative to the base;

a driving unit retained between the first side walls of the support frame;

a planet gear set mounted on one of the first side walls and driven by the driving unit, said planet gear set including first and second rotatable spindles;

a jumping control unit including a rotary cam plate disposed on one of the first side walls of the support frame and driven by the second rotatable spindle so as to rotate in a predetermined direction, said cam plate having a large semi-circular portion and a smaller semi-circular portion with a flat side which is disposed on a flat side of the large semi-circular portion and which extends from one end of the flat side of the large semi-circular portion, said cam plate being disposed below and having a periphery which abuts with the outward projection of the swing arm, said jumping control unit further having a tension spring with a first end hooked to an upper rear end of the swing arm and a second end which is hooked to an upper front end of the support frame; and a direction control unit including: a stationary rod which extends vertically upward from the base; a coil spring which is wrapped tightly around the first rotatable spindle and which has a bent end; and a torsion spring which has a first end secured to the base and a second end secured to the U-shaped leg, said torsion spring biasing the U-shaped leg toward the normal position;

whereby, rotation of the cam plate initially causes the cam plate to urge the outward projection upward so as to cause the swing arm to pivot upwardly from a first position relative to the support frame, pivoting movement of the swing arm causing the tension spring to stretch and further causing the support frame to move vertically downward relative to the vertically extending parts of the U-shaped leg, rotation of the first rotatable spindle causing the coil spring to rotate therewith such that the bent end of the coil spring eventually abuts against the stationary rod, further rotation of the first rotatable spindle causing the U-shaped leg to pivot about the base simultaneous with pivoting movement of the swing arm against action of the torsion spring, further rotation of the cam plate eventually causing the cam plate to cease upward urging of the outward projection, thereby causing the tension spring to contract instantaneously and cause the swing arm to pivot instantaneously back to the first position and lift the U-shaped leg so as to enable the jumping mechanism to execute a jumping movement, said stationary rod ceasing to abut against the bent end of the coil spring when the U-shaped leg is lifted, and said torsion spring rotating the U-shaped leg to the normal position simultaneous with the jumping movement of the jumping mechanism.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
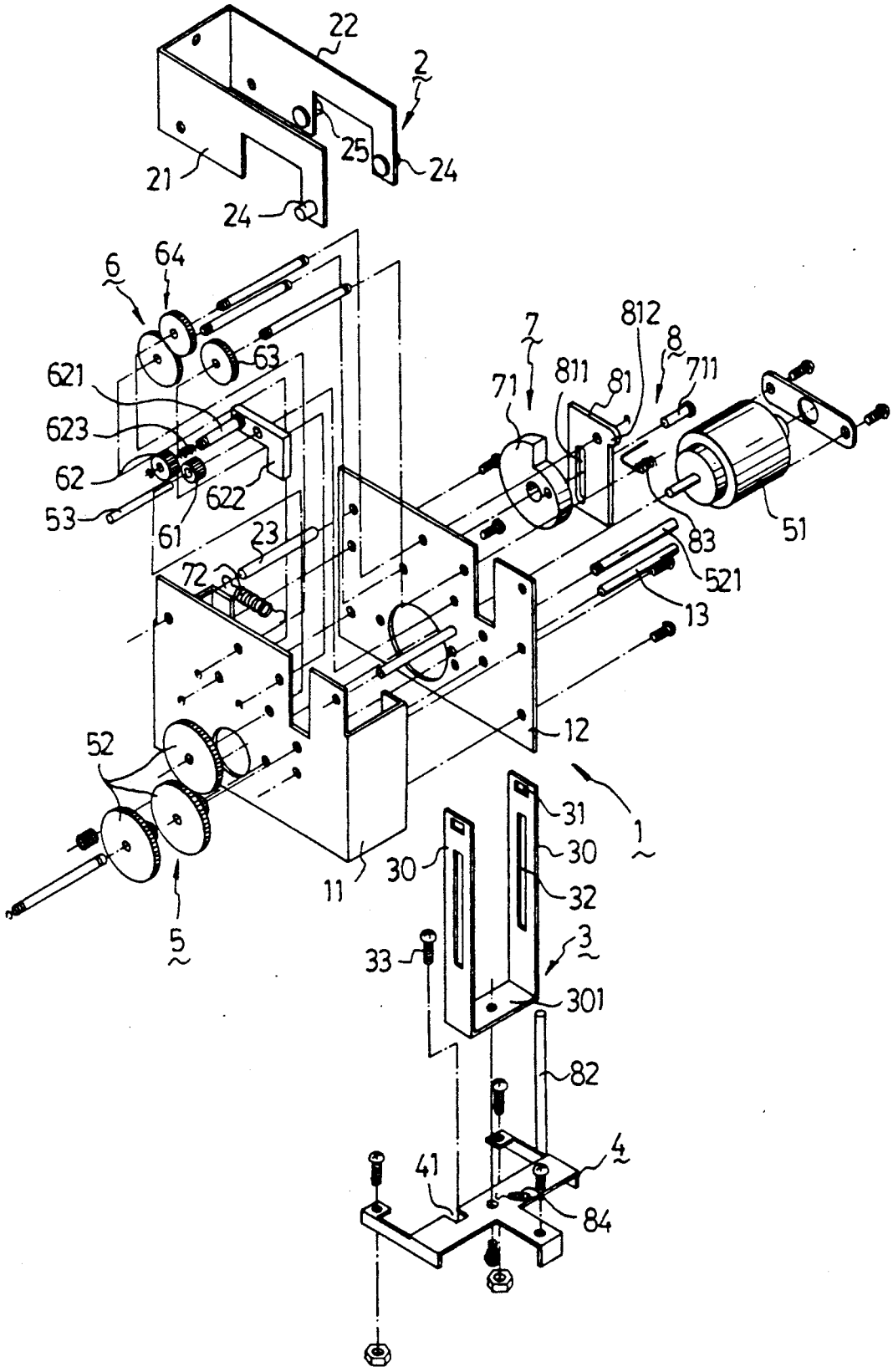
FIG. 1 is an exploded view of the preferred embodiment of a jumping mechanism according to the present invention.
Figure 2:
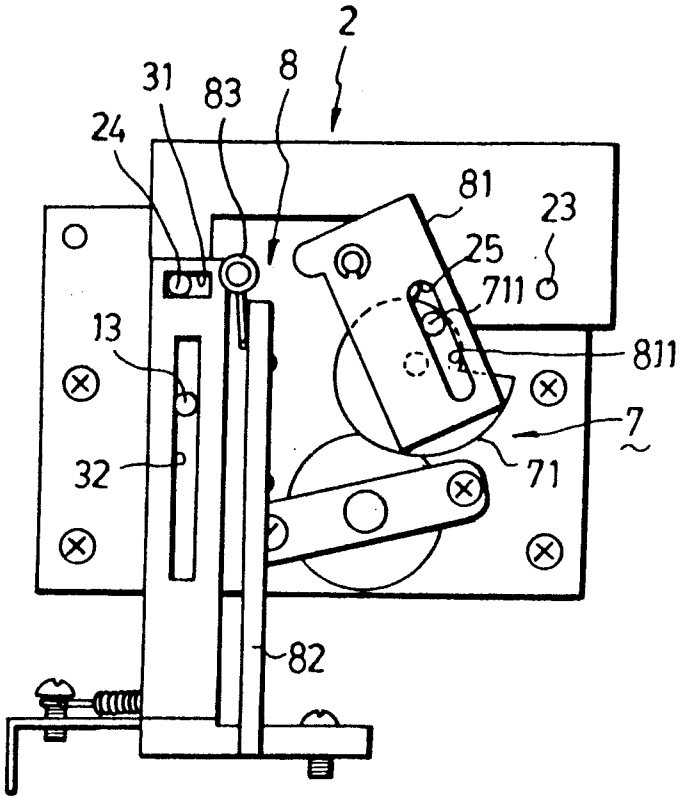
FIG. 2 is a right side view of the preferred embodiment.

Referring to FIGS. 1 and 2, the preferred embodiment of a jumping mechanism according to the present invention is shown to comprise a support frame a swing arm (2), a U-shaped leg (3), a base (4), a driving unit (5), a planetary gear set (6), a jumping control unit (7) and a direction control unit (8).

The support frame (1) includes left and right side walls (11, 12). A rod (13) extends between the left and right side walls (11, 12) adjacent to a front end of the same. The left and right side walls (21, 22) of the swing arm (2) are pivoted to the side walls (11, 12) adjacent to a rear upper end of the latter by means of a pivot pin (23). The U-shaped leg (3) includes a pair of vertically extending parts (30) and a bottom part (301) which interconnects the lower ends of the vertically extending parts (30). Each of the vertically extending parts (30) has an upper end which is formed with a through hole (31) that engages a pivot projection (24) on a corresponding one of the side walls (21, 22). The U-shaped leg (3) is thus mounted pivotally on the swing arm (2). Each of the vertically extending parts (30) is further provided with a vertically extending slot (32). The rod (13) extends through the vertically extending parts (30) of the U-shaped leg (3) via the slots (32). The support frame (1) is thus movable vertically relative to the U-shaped leg (3). The bottom part (301) of the U-shaped leg (3) is mounted rotatably on the base (4).

Figure 3:
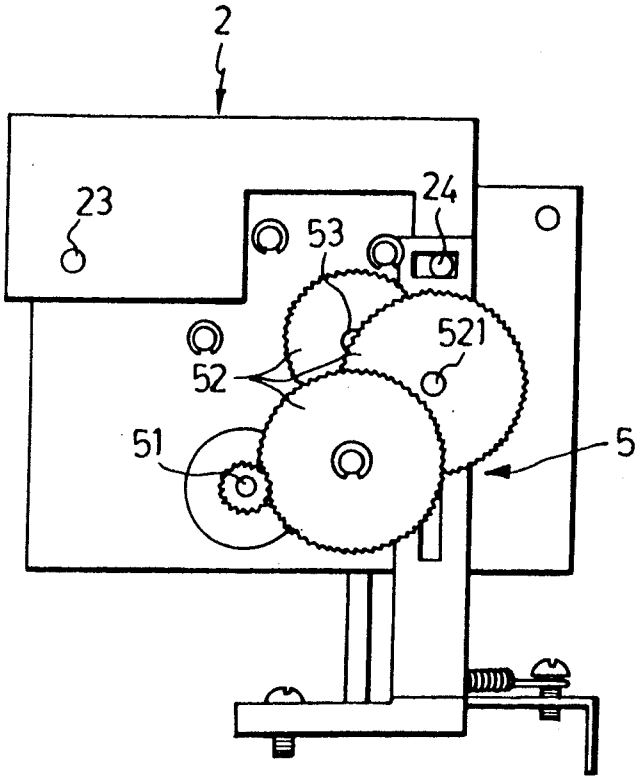
FIG. 3 is a left side view of the preferred embodiment.

Referring to FIGS. 1, 2 and 3, the driving unit (5) includes a drive power source (51), which is retained between the side walls (11, 12) of the support frame (1), and a speed reduction gear set (52) which is mounted on an outer surface of the left side wall (11) and which is operably driven by the drive power source (51).

Figure 4:
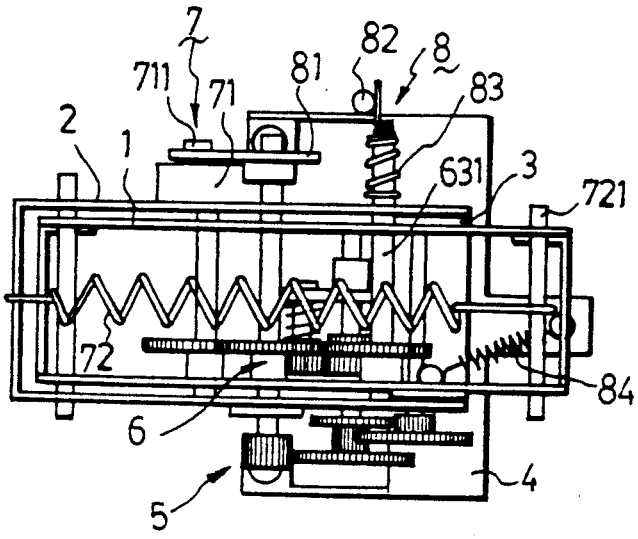
FIG. 4 is a top view of the preferred embodiment.
Figure 5:
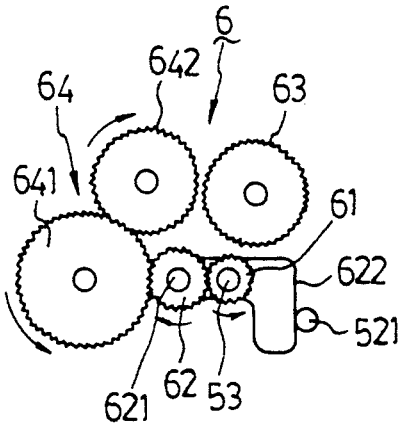
FIG. 5 illustrates a planetary gear set of the preferred embodiment when in a first operating state.
Figure 6:
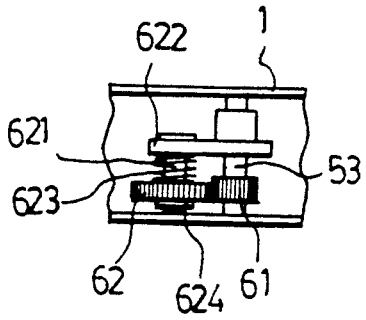
FIG. 6 is an enlarged top view of a portion of the preferred embodiment.

Referring to FIGS. 4, 5 and 6, the planetary gear set (6) is mounted on an inner surface of the left side wall (11) and is rotatably driven by an output shaft (53) of the speed reducing gear set (52). The planetary gear set (6) includes a central gear (61) which is mounted securely on the output shaft (53), a planet gear (62) which meshes with the central gear (61), and a peripheral gear (63) and a peripheral gear set (64) which are operably driven by the planet gear (62). The peripheral gear set (64) includes a large gear wheel (641) and a smaller gear wheel (642) which meshes with the large gear wheel (641). The planet gear (62) is mounted rotatably on a stationary spindle (621). One end of the spindle (621) is fixed on an L-shaped gear carrier (622). A compression spring (623) is provided around the spindle (621) between the planet gear (62) and the gear carrier (622), thus urging the planet gear (62) to abut tightly against a locking ring (624) on the spindle (621). The gear carrier (622) is mounted pivotally on the output shaft (53) of the speed reducing gear set (52).

When the output shaft (53) of the gear set (52) rotates in a counterclockwise direction, the central gear (61) rotates in the same direction and causes the planet gear (62) to rotate in a clockwise direction. The compression spring (623) urges the planet gear (62) to abut tightly against the locking ring (624), thus resulting in a friction force which retards the rotation of the planet gear (62). A portion of the driving force which is applied by the central gear (61) on the planet gear (62) is transferred to the spindle (621), thereby causing the gear carrier (622) to pivot in a counterclockwise direction. In the preferred embodiment, a spindle (521) of the speed reducing gear set (52) is used to limit counterclockwise movement of the gear carrier (622). Only the peripheral gear set (64) is driven by the planet gear (62) at this stage.

Figure 7:
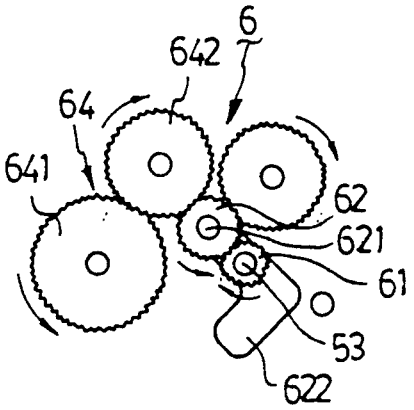
FIG. 7 illustrates the planetary gear set when in a second operating state.

Referring to FIG. 7, when the output shaft (53) of the gear set (52) rotates in a clockwise direction, the central gear (61) rotates in the same direction and causes the planet gear (62) to rotate in a counterclockwise direction. Due to the action of the compression spring (623), a portion of the driving force which is applied by the central gear (61) on the planet gear (62) is transferred to the spindle (621), thereby causing the gear carrier (622) to pivot in a clockwise direction. The planet gear (62) eventually meshes with the peripheral gear (63) and the smaller gear wheel (642) of the peripheral gear set (64), thereby causing clockwise rotation of the same. The large gear wheel (641) rotates in a counterclockwise direction at this stage.

Referring to FIGS. 1, 2 and 4, the jumping control unit (7) includes a rotary cam plate (71) which is carried on the rotatable spindle of the large gear wheel (641) and which is disposed on an outer surface of the right side wall (12). The cam plate (71) has a large semi-circular portion and a smaller semi-circular portion that has a flat side which is disposed on a flat side of the large semi-circular portion and which extends from one end of the flat side of the latter. A tension spring (72) has a first end which is hooked to the upper rear end of the swing arm (2) and a second end which is hooked to a rod (721) which extends between the side walls (11, 12) at the upper front end of the support frame (1). The cam plate (71) is disposed below and has a periphery which abuts with an outward projection (25) that is formed on the right side wall (22) of the swing arm (2).

The direction control unit (8) includes a spring control plate (81) which is mounted pivotally on the right side wall (12) of the support frame (1) and which is rotatably driven by the cam plate (71), a stationary rod (82) which extends vertically upward from the base (4), a coil spring (83) which is wrapped tightly around a portion of the rotatable spindle (631) of the peripheral gear (63), which portion extends through the right side wall (12) of the support frame (1), and a torsion spring (84) which has a first end secured to the base (4) and a second end secured to the U-shaped leg (3). The torsion spring (84) biases the U-shaped leg (3) toward a normal position relative to the base (4).

The spring control plate (81) is a substantially rectangular plate which is formed with a vertically extending slot (811). A drive shaft (711) extends outwardly from the smaller semi-circular portion of the cam plate (71) and extends into the slot (811), thereby causing the spring control plate (81) to swing forward and rearward relative to the support frame (1) whenever the cam plate (71) is rotated.

Figure 8:
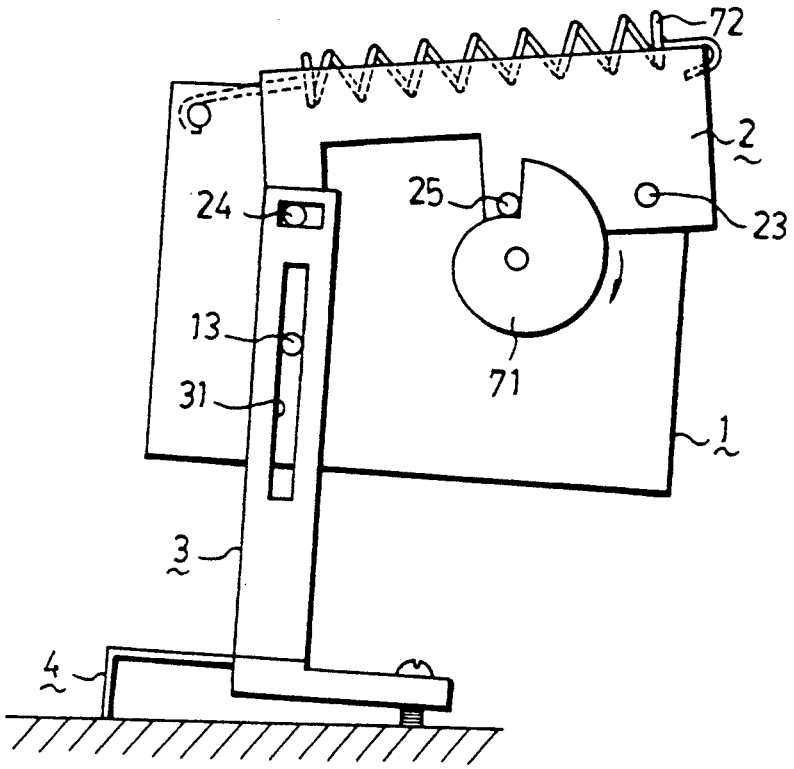
FIGS. 8 to 10 illustrate the jumping action of the preferred embodiment.
Figure 9:
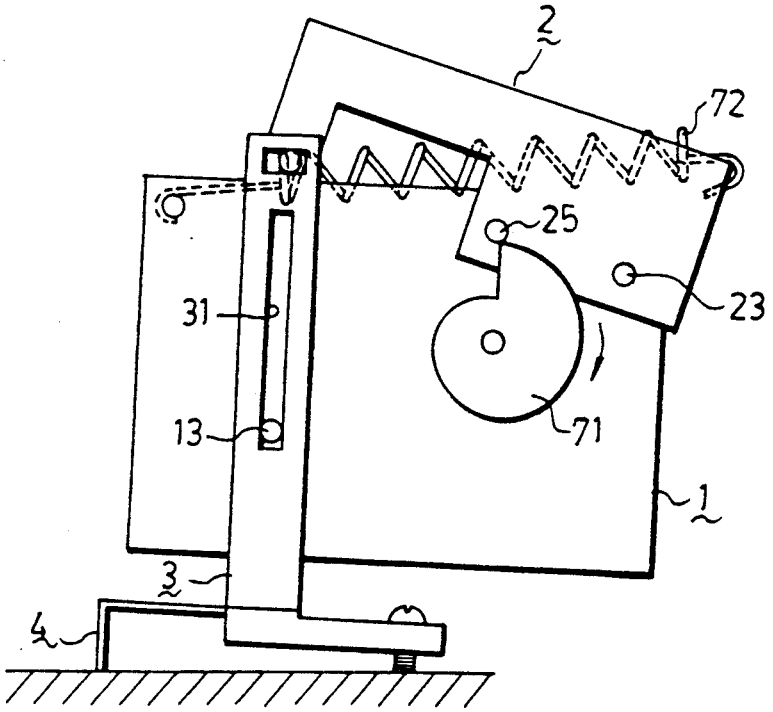
Figure 10:
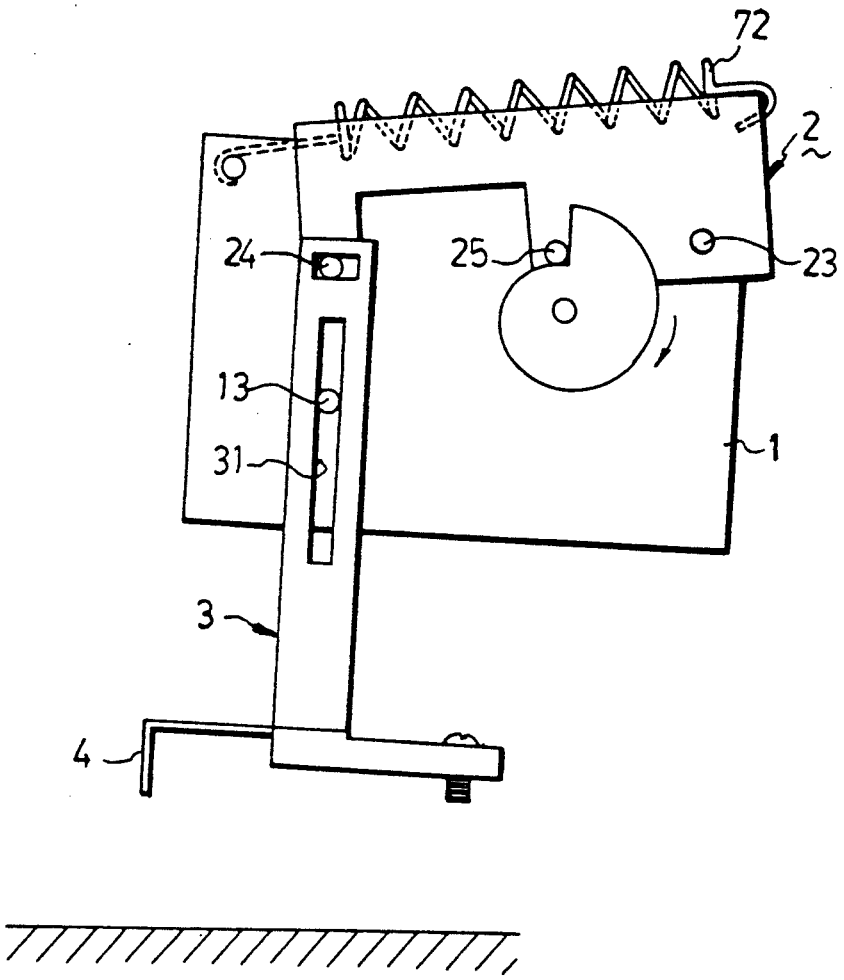

FIGS. 8 to 10 illustrate the jumping action of the preferred embodiment. Rotation of the large gear wheel (641) of the peripheral gear set (64) causes the cam plate (71) to rotate therewith in a clockwise direction. Rotation of the cam plate (71) in this direction causes the outward projection (25), which initially abuts against the periphery of the smaller semi-circular portion of the cam plate (71), to contact the periphery of the large semi-circular portion of the cam plate (71). At this stage, the cam plate (71) urges the outward projection (25) upward so as to cause the swing arm (2) to pivot upwardly relative to the support frame (1), as shown in FIG. 9. Since the front ends of the side walls (21, 22) of the swing arm (2) are connected pivotally to the upper ends of the vertically extending parts (30) of the U-shaped leg (3), the pivoting movement of the swing arm (2) causes the support frame (1) to move vertically downward relative to the vertically extending parts (30) of the U-shaped leg (3). The tension spring (72) is stretched at this stage.

Further clockwise rotation of the cam plate (71) causes the outward projection (25) to contact abruptly the periphery of the smaller semi-circular portion of the cam plate (71), as shown in FIG. 10. The cam plate (71) ceases to urge the outward projection (25) upward, thereby causing the tension spring (72) to contract instantaneously. The swing arm (2) pivots instantaneously to its original position, thereby lifting the U-shaped leg (3) from the ground so as to enable the preferred embodiment to execute a jumping movement, as shown in FIG. 10. The front end of the base (4) is preferably bent upward with respect to the rear end of the same, thereby guiding the preferred embodiment to jump in a forward direction.

Figure 11:
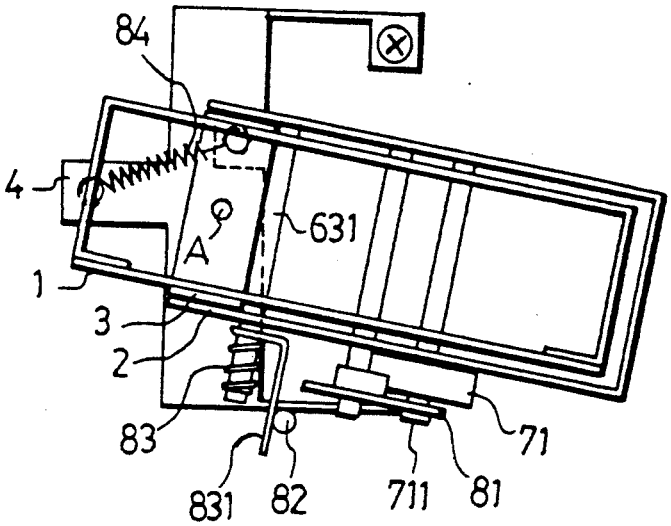
FIGS. 11 to 14 illustrate how direction control is achieved by the preferred embodiment.
Figure 12:
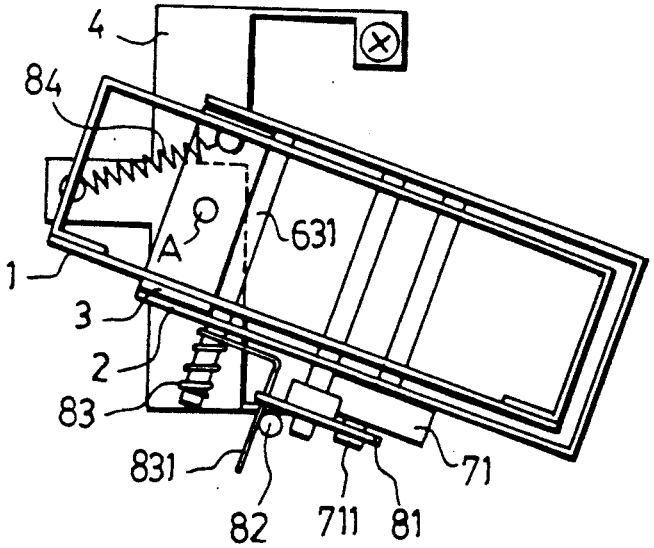
Figure 13:
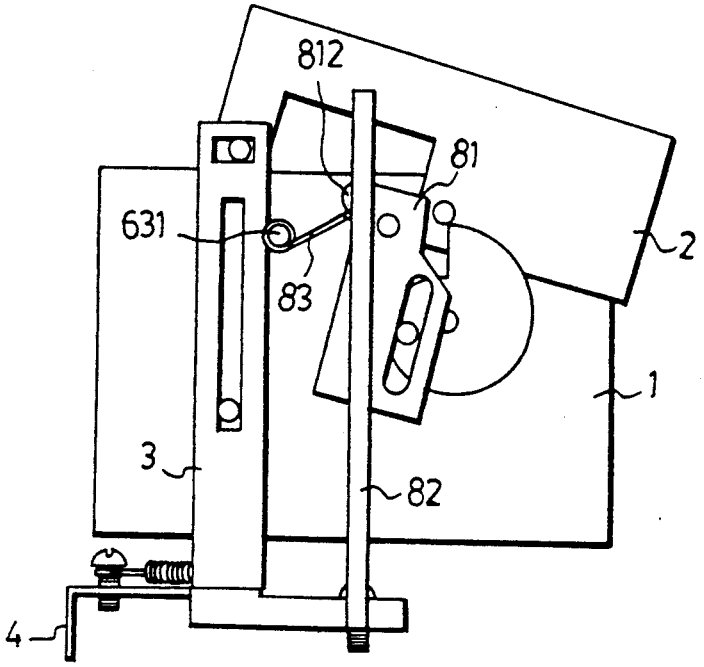

Referring to FIG. 4 and to FIGS. 11 to 14, rotation of the spindle (631) of the peripheral gear (63) causes the coil spring (83) to rotate therewith. The coil spring (83) has a bent end (831) which eventually abuts against the stationary rod (82). Further rotation of the spindle (631) causes the support frame (1) and the U-shaped leg (3) to pivot about a mounting point (A) on the base (4) against the action of the torsion spring (84), as shown in FIG. 11. The bent end (831) of the coil spring (83) move upwardly along the stationary rod (82) when the support frame (1) and the U-shaped leg (3) pivot relative to the base (4). After the support frame (1) and the U-shaped leg (3) have rotated by a predetermined maximum angle, as shown in FIG. 4, further upward movement by the bent end (831) of the coil spring (83) is limited by a rounded projection (812) on the spring control plate (81). The force exerted by the rounded projection (812) on the bent end (831) is sufficient to overcome the friction force between the coil spring (83) and the spindle (631), thereby preventing further rotation of the coil spring (83) with the spindle (631).

Figure 14:
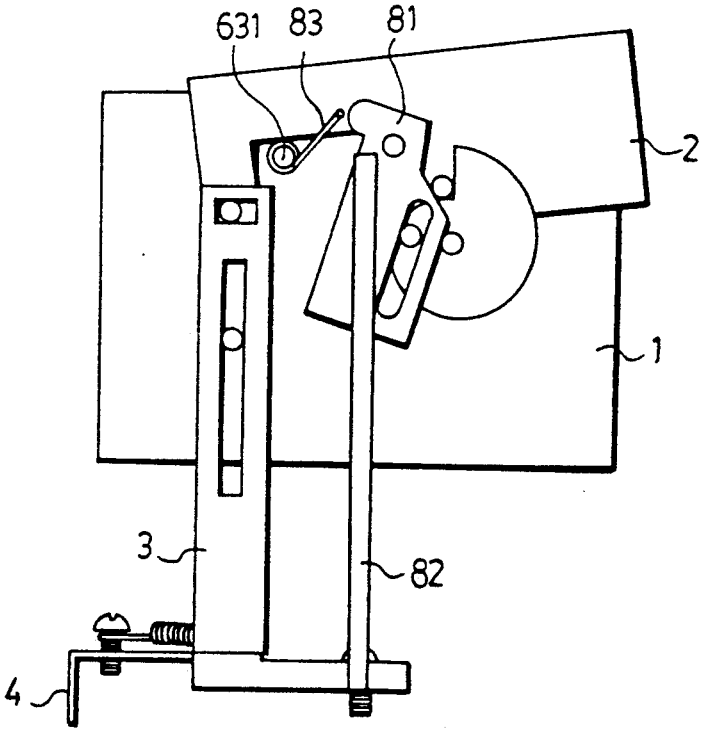

Referring to FIG. 14, when the cam plate (71) instantaneously ceases to urge the swing arm (2) to pivot upwardly, the jumping mechanism of the present invention executes a forward jumping movement. The stationary rod (82) instantaneously moves downward relative to the coil spring (83) and ceases to abut with the bent end (831) of the latter. At the same time, the cam plate (71) rotates the spring control plate (81) so as to prevent the rounded projection (812) from hindering the rotation of the coil spring (83) with the spindle (631). The spring force of the torsion spring (84) is used to rotate the support frame (1) and the U-shaped leg (3) to the normal position when the jumping mechanism of the present invention executes a forward jumping movement. Referring once more to FIG. 1, the base (4) is formed with a peripheral notch (41), while a screw (33) is secured to the bottom part (301) of the U-shaped leg (3). The notch (41) and the screw (33) permit the U-shaped leg (3) to return properly to the normal position.

It has been shown from the foregoing description that the driving output of the driving unit (5) can be converted into a jumping movement. A change in direction is also achieved with each jumping movement. The jumping mechanism of the present invention is thus ideal for use in toys.

The jumping mechanism of the present invention can be operated so that no change in direction occurs each time a jumping movement is being executed by the same. Referring once more to FIG. 5, when the output shaft (53) of the gear set (52) rotates in a counterclockwise direction, the central gear (61) rotates in the same direction and causes the planet gear (62) to rotate in a clockwise direction. Due to the action of the compression spring (623), a portion of the driving force which is applied by the central gear (61) on the planet gear (62) is transferred to the spindle (621), thereby causing the gear carrier (622) to pivot in a counterclockwise direction. Note that the spindle (521) of the speed reducing gear set (52) limits counterclockwise movement of the gear carrier (622). Only the peripheral gear set (64) is driven by the planet gear (62), and the peripheral gear (63) does not rotate at this stage. Therefore, rotation of the coil spring (83) does not occur, thereby preventing pivoting movement of the support frame (1) and the U-shaped leg (3) relative to the base (4).

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A jumping mechanism, comprising:

a support frame having a spaced pair of first side walls and a rod which extends between said first side walls adjacent to a front end of said support frame;

a swing arm having a spaced pair of second side walls pivoted to said first side walls of said support frame adjacent to a rear upper end of said support frame, one of said second side walls being provided with an outward projection;

a U-shaped leg having a pair of vertically extending parts, each of said vertically extending parts having an upper end that is mounted pivotally on a corresponding one of said second side walls, each of said vertically extending parts further having a vertically extending slot, said rod extending through said vertically extending parts via said slots;

a driving unit retained between said first side walls of said support frame; and a jumping control unit including a rotary cam plate mounted on one of said first side walls of said support frame and driven by said driving unit to rotate in a predetermined direction, said cam plate having a large semi-circular portion and a smaller semi-circular portion with a flat side which is disposed on a flat side of said large semi-circular portion and which extends from one end of said flat side of said large semi-circular portion, said cam plate being disposed below and having a periphery which abuts with said outward projection of said swing arm, said jumping control unit further having a tension spring with a first end hooked to an upper rear end of said swing arm and a second end which is hooked to an upper front end of said support frame;

whereby, rotation of said cam plate initially causes said cam plate to urge said outward projection upward so as to cause said swing arm to pivot upwardly from a first position relative to said support frame, pivoting movement of said swing arm causing said tension spring to stretch and further causing said support frame to move vertically downward relative to said vertically extending parts of said U-shaped leg, further rotation of said cam plate eventually causing said cam plate to cease upward urging of said outward projection, thereby causing said tension spring to contract instantaneously, said swing arm pivoting instantaneously back to the first position and lifting said U-shaped leg so as to enable said jumping mechanism to execute a jumping movement.

2. A jumping mechanism, comprising:

a support frame having a spaced pair of first side walls and a rod which extends between said first side walls adjacent to a front end of said support frame;

a swing arm having a spaced pair of second side walls pivoted to said first side walls of said support frame adjacent to a rear upper end of said support frame, one of said second side walls being provided with an outward projection;

a base;

a U-shaped leg having a pair of vertically extending parts and a bottom part which interconnects lower ends of said vertically extending parts, each of said vertically extending parts having an upper end that is mounted pivotally on a corresponding one of said second side walls, each of said vertically extending parts further having a vertically extending slot, said rod extending through said vertically extending parts via said slots, said bottom part being mounted rotatably on said base;

one of said base and said bottom part of said U-shaped leg being formed with a peripheral notch, the other one of said base and said bottom part of said U-shaped leg being formed with a protrusion which is received in said notch when said U-shaped leg is at a normal position relative to said base;

a driving unit retained between said first side walls of said support frame;

a planet gear set mounted on one of said first side walls and driven by said driving unit, said planet gear set including first and second rotatable spindles;

a jumping control unit including a rotary cam plate disposed on one of said first side walls of said support frame and driven by said second rotatable spindle so as to rotate in a predetermined direction, said cam plate having a large semi-circular portion and a smaller semi-circular portion with a flat side which is disposed on a flat side of said large semi-circular portion and which extends from one end of said flat side of said large semi-circular portion, said cam plate being disposed below and having a periphery which abuts with said outward projection of said swing arm, said jumping control unit further having a tension spring with a first end hooked to an upper rear end of said swing arm and a second end which is hooked to an upper front end of said support frame; and a direction control unit including: a stationary rod which extends vertically upward from said base; a coil spring which is wrapped tightly around said first rotatable spindle and which has a bent end; and a torsion spring which has a first end secured to said base and a second end secured to said U-shaped leg, said torsion spring biasing said U-shaped leg toward the normal position;

whereby, rotation of said cam plate initially causes said cam plate to urge said outward projection upward so as to cause said swing arm to pivot upwardly from a first position relative to said support frame, pivoting movement of said swing arm causing said tension spring to stretch and further causing said support frame to move vertically downward relative to said vertically extending parts of said U-shaped leg, rotation of said first rotatable spindle causing said coil spring to rotate therewith such that said bent end of said coil spring eventually abuts against said stationary rod, further rotation of said first rotatable spindle causing said U-shaped leg to pivot about said base simultaneous with pivoting movement of said swing arm against action of said torsion spring, further rotation of said cam plate eventually causing said cam plate to cease upward urging of said outward projection, thereby causing said tension spring to contract instantaneously and cause said swing arm to pivot instantaneously back to the first position and lift said U-shaped leg so as to enable said jumping mechanism to execute a jumping movement, said stationary rod ceasing to abut against said bent end of said coil spring when said U-shaped leg is lifted, and said torsion spring rotating said U-shaped leg to the normal position simultaneous with the jumping movement of said jumping mechanism.

3. The jumping mechanism as claimed in claim 2, wherein:

said driving unit has an output shaft; and said planet gear set further comprises: a central gear which is mounted securely on said output shaft; a planet gear which meshes with said central gear; and first and second peripheral gear means which mesh with said central gear and which drive respectively said first and second rotatable spindles.

4. The jumping mechanism as claimed in claim 3, wherein said planet gear set further comprises means for selectively engaging said planet gear and said first peripheral gear means.

5. The jumping mechanism as claimed in claim 4, wherein said selective engaging means comprises:

a gear carrier which is mounted pivotally on said output shaft;

a stationary spindle having a first end secured to said gear carrier and a second end provided with a locking ring, said planet gear being mounted rotatably on said second end of said stationary spindle inwardly of said locking ring; and a compression spring provided around said stationary spindle between said planet gear and said gear carrier to bias said planet gear toward said locking ring;

rotation of said central gear in a first direction causing said gear carrier to pivot and move said planet gear away from said first peripheral gear means, rotation of said central gear in a second direction opposite to said first direction causing said gear carrier to pivot and move said planet gear toward said first peripheral gear means.

* * * * *